US008941058B2

(12) United States Patent
Franzen

(10) Patent No.: US 8,941,058 B2
(45) Date of Patent: Jan. 27, 2015

(54) UTILIZING GAS FLOWS IN MASS SPECTROMETERS

(75) Inventor: Jochen Franzen, Bremen (DE)

(73) Assignee: Bruker Daltonik GmbH, Bremen (DE)

( * ) Notice: Subject to any disclaimer, the term of this patent is extended or adjusted under 35 U.S.C. 154(b) by 48 days.

(21) Appl. No.: 13/503,202

(22) PCT Filed: Nov. 15, 2010

(86) PCT No.: PCT/EP2010/067481

§ 371 (c)(1),
(2), (4) Date: Apr. 20, 2012

(87) PCT Pub. No.: WO2011/061147

PCT Pub. Date: May 26, 2011

(65) Prior Publication Data

US 2012/0228492 A1 Sep. 13, 2012

(30) Foreign Application Priority Data

Nov. 17, 2009 (DE) ..... 10 2009 053 582

(51) Int. Cl.
*H01J 49/04* (2006.01)
*H01J 49/42* (2006.01)
*H01J 49/40* (2006.01)

(52) U.S. Cl.
CPC ..... *H01J 49/421* (2013.01); *H01J 49/401* (2013.01)
USPC ..... 250/288

(58) Field of Classification Search
USPC ..... 250/281–330
See application file for complete search history.

(56) References Cited

U.S. PATENT DOCUMENTS

| | | | | |
|---|---|---|---|---|
| 4,339,782 | A | 7/1982 | Yu | |
| 6,420,699 | B1 * | 7/2002 | Herschbach et al. | 250/251 |
| 7,196,326 | B2 * | 3/2007 | Franzen et al. | 250/288 |
| 7,838,826 | B1 * | 11/2010 | Park | 250/288 |
| 2002/0027196 | A1 | 3/2002 | Shiokawa | |
| 2003/0155496 | A1 | 8/2003 | Kalinitchenko | |

(Continued)

FOREIGN PATENT DOCUMENTS

| | | | | |
|---|---|---|---|---|
| EP | 0237259 | A2 | 9/1987 | |
| WO | 9856030 | A2 | 12/1998 | |
| WO | WO-2008-146440 | * | 12/2008 | H01J 49/40 |

*Primary Examiner* — Jack Berman
*Assistant Examiner* — Eliza Osenbaugh-Stewart
(74) *Attorney, Agent, or Firm* — Robic, LLP

(57) ABSTRACT

The invention relates to ions guided by gas flows in mass spectrometers, particularly in RF multipole systems, and to RF quadrupole mass filters and their operation with gas flows in tandem mass spectrometers. The invention provides a tandem mass spectrometer in which the RF quadrupole mass filter is operated at vacuum pressures in the medium vacuum pressure regime, utilizing a gas flow to drive the ions are through the mass filter. Vacuum pressures between 0.5 to 10 pascal are maintained in the mass filter. The mass filter may be enclosed by a narrow enclosure to guide the gas flow. The quadrupole mass filter may be followed by an RF multipole system, operated at the same vacuum pressure, serving as fragmentation cell to fragment the selected parent ions. The fragmentation cell may be enclosed by the same enclosure which already encloses the mass filter, so the ions may be driven by the same gas flow at the same vacuum pressure, greatly simplifying the required vacuum pumping system in tandem mass spectrometers. There are many other applications utilizing gas flows including supersonic gas jets in mass spectrometry.

15 Claims, 4 Drawing Sheets

(56) References Cited

U.S. PATENT DOCUMENTS

| | | | | |
|---|---|---|---|---|
| 2004/0011955 | A1 | 1/2004 | Hirano | |
| 2006/0151692 | A1 | 7/2006 | Collings | |
| 2007/0262253 | A1 | 11/2007 | Guo | |
| 2007/0272849 | A1 | 11/2007 | Kirihara | |
| 2009/0212210 | A1* | 8/2009 | Finlay et al. | 250/288 |
| 2009/0218486 | A1 | 9/2009 | Whitehouse | |
| 2011/0006203 | A1 | 1/2011 | Fujita | |
| 2011/0174966 | A1* | 7/2011 | Wollnik et al. | 250/286 |

* cited by examiner

UTILIZING GAS FLOWS IN MASS SPECTROMETERS

FIELD OF INVENTION

The invention relates to the guidance of ions in mass spectrometers, particularly in RF multipole systems, and to RF quadrupole mass filters and mass analyzers and their operation.

PRIOR ART

Nomenclature: When the general term "RF multipole systems" is used here, this refers to all kinds of system which can hold the ions together near to an axis of the system, by the use of suitable pseudopotentials, including RF multipole rod systems, ion guide systems with double or multiple helices, with stacked rings, or with diaphragm stacks of other shapes. This includes the well-known "ion funnels", which consist of annular diaphragms with continuously decreasing diameters, and in which the ions are driven toward the outlet of the funnel by DC voltages superimposed on the RF voltages. The term "RF multipole rod systems" refers to all the systems that consist of pole rods arranged symmetrically around an axis, such as hexapole or octopole rod systems containing six or eight pole rods. When RF multipole rod systems are operated within a medium vacuum, they show a "collision focusing" effect. "Collision focusing" means that radial motions of the ions are damped through impacts with the light gas molecules so that the ions accumulate along the axis of the system due to the repelling forces of the pseudopotential. The term "RF quadrupole rod systems" refers to systems having precisely four pole rods; they generate a two-dimensional RF quadrupole field within their cross-section. The pseudopotential of this quadrupole field exhibits the strongest retroactive forces toward the axis, therefore, they show the strongest collision focusing of all RF multipole systems. Through the simultaneous use of defocusing DC voltages and focusing RF voltages, the RF quadrupole rod system is turned into a "mass filter" that can be set up in such a way that only ions within a small range $\Delta(m/z)$ around a charge-related mass m/z are transmitted, while all the other ions are destabilized, collide with the pole rods, and are therefore filtered out (m=physical mass, z=number of unpaired elementary charges on the ion).

Definition of pressure ranges:

| | | |
|---|---|---|
| Low vacuum: | $3 \times 10^4$-$10^2$ pascal (300-1 mbar) | 0.3 μm-0.1 mm mean free path |
| Medium vacuum: | $10^2$-$10^{-1}$ pascal (1-$10^{-3}$ mbar) | 0.1-100 mm mean free path |
| High vacuum: | $10^{-1}$-$10^{-5}$ pascal ($10^{-3}$-$10^{-7}$ mbar) | 100 mm-1 km mean free path |
| Ultrahigh vacuum: | $10^{-5}$-$10^{-10}$ pascal ($10^{-7}$-$10^{-12}$ mbar) | 1 km-$10^5$ km mean free path |

The pressure ranges are necessarily not precisely confined. In English-speaking countries, the range covering both low and medium vacuum together is conventionally termed "rough vacuum". In low vacuum, the gas flow character is purely viscous; in medium vacuum, a transition takes place from viscous flow to Knudsen flow and then to molecular flow; in high and ultrahigh vacuum, we find molecular flow.

Modern mass spectrometers quite often apply ion sources in which analyte substances are ionized at atmospheric pressure ($10^5$ pascal). These mass spectrometers require differential pumping systems that finally can generate a high vacuum ($10^{-1}$ to $10^{-5}$ pascal) or even ultrahigh vacuum ($10^{-5}$ to $10^{-10}$ pascal) needed for the operation of the mass analyzers. The differential pumping systems require a number of pump stages in which the pressure drops in steps covering many (up to 15!) orders of magnitude. The pump stages are separated from each other by tiny openings through which the ions have to pass. In tandem mass spectrometers, usually mass filters operating under high vacuum ($<10^{-3}$ pascal) are included upstream of a mass analyzer in order to select parent ions, followed downstream by multipole systems under medium vacuum ($\sim 10^1$ pascal) used to fragment the parent ions by collisions or by reactions with ions of different polarity. This generates falls and rises in pressure over many orders of magnitude each, created by use of said differential pumping systems and by the additional introduction of gases. In most cases, the manufacturer of the mass spectrometer does nothing more than providing the right pressures in the right locations by a complicated differential pumping system, but only vaguely guessing about the flow conditions—the "winds and storms"—in the mass spectrometer. Calculations or simulations of gas flows and their utilization in mass spectrometers are rare.

The gas flows within the mass spectrometer—the winds and the storms, particularly the storms through the tiny openings between the pressure stages—however, have an effect on the motion of the ions, at least in the regimes of viscous flow in the low vacuum pressure range and of Knudsen flow in the medium vacuum pressure range. Jets of gas molecules that are deflected to the side in a non-reproducible way, for instance as a result of tiny burrs at the openings, or heavily turbulent gas flows, can result in inexplicable ion behavior, to the point where the mass spectrometer becomes unusable.

In general, an attempt is made to transport the ions as quickly as possible through the stages of medium vacuum pressure into the high vacuum pressure region, where a large mean free path length prevails, and where the ions can be guided by ion-optical means with very few collisions. In the high and ultrahigh vacuum pressure regime, use is made of spatially short electrical accelerations and free flight of the ions by their inertia. As a rule, the medium vacuum pressure region is not used for mass spectrometric analysis or filtering of the ions, occasionally, this region is used to measure ion mobilities. RF ion traps are an exception to this rule.

As already described, manufacturers usually don't care much about flow conditions. During recent years, however, some groups of academic scientists working in this field generated, at will, supersonic gas jets containing ions for ion guiding and even used supersonic gas jets to introduce ions into quadrupole mass analyzers.

The document US 2006/015169 A1 (B. A. Collings et al.) describes a mass spectrometer, wherein ions from an ion source pass through an inlet aperture into a vacuum chamber before being transmitted to mass analysis by the mass analyzer. The configuration of the inlet aperture forms a sonic orifice or sonic nozzle and with a predetermined vacuum chamber pressure, and a supersonic free jet expansion is created in the vacuum chamber that entrains the ions within a barrel shock and Mach disc. Once formed, an ion guide with a predetermined cross-section to essentially radially confine the supersonic free jet expansion can focus the ions for transmission through the vacuum chamber. This effectively improves the ion transmission between the ion source and the mass analyzer. The multipole systems are here used to catch the ions.

The document US 2009/0212210 A1 (A. Finlay et al.) describes a vacuum interface for a mass spectrometer system formed from a diverging nozzle (a "Laval nozzle") which forms a supersonic gas beam. The vacuum interface may be used to transfer a beam of ions from an atmospheric pressure ionization source into a vacuum chamber for analysis by a mass analyzer. In one embodiment, the supersonic gas beam is directed immediately into the quadrupole mass analyzer, but the document is silent about vacuum pressures in the supersonic gas beams or in the mass analyzers.

In the document US 2004/0011955 A1 (Y Hirano et al.), an ion attachment mass spectrometry apparatus is described with a first and a second chamber separated by a partition having an aperture (nozzle). If the Knudsen number of the aperture is made not larger than 0.01, and the pressure of the second chamber is not higher than 1/10th of that of the first chamber, a supersonic jet is formed in the second chamber. Sample gas and metal ions are injected into the supersonic jet region and metal ions are made to attach to the sample gas molecules. The supersonic jet is directed through a quadrupole mass analyzer which is operated at vacuum pressures between $10^{-3}$ and $10^{-1}$ pascal. It is not described whether the mass analyzer works correctly at the high end of this vacuum pressure range.

Supersonic gas jets in the medium vacuum pressure range have a minimum speed of 300 meters per second, in general, the speed reaches up to a maximum near 800 meters per second. In vacuum pressures of about $10^{-1}$ pascal, the jet speed usually assumes about 600 to 700 meters per second. Guiding the ions within a supersonic jet through an RF quadrupole analyzer or an RF quadrupole mass filter may be, however, too fast for a good mass selection because the ions experience too few cycles of the RF before they exit the mass filter again.

OBJECTIVE OF THE INVENTION

An objective of the invention is to simplify design and operation of mass spectrometers, operating with ion sources at pressures above 100 pascal and with quadrupole mass filters to select the parent ions for subsequent fragmentation or with quadrupole mass analyzers. Further objectives relate in general to the utilization of gas flows inside mass spectrometers, including both supersonic jets and subsonic laminar gas flows.

SUMMARY OF THE INVENTION

Primarily, the invention provides a mass spectrometer in which a RF quadrupole mass filter or an RF quadrupole mass analyzer is operated at vacuum pressures in the medium vacuum pressure regime, utilizing a laminar gas flow of moderate speed to drive the ions through the mass filter. Vacuum pressures between 0.5 to 10 pascal are preferably applied, nitrogen, helium or hydrogen are preferably used as flowing gas. RF ion guides may be used up- and downstream of the RF quadrupole systems at the same pressure without being separated by apertures. The quadrupole mass filter may be followed downstream by an RF multipole system, again operated at the same vacuum pressure, serving as fragmentation cell in a tandem mass spectrometer to fragment the selected parent ions. Also in this RF multipole system, the ions are driven by a gas flow, which may be the same gas flow, or a combined gas flow by the addition of a second gas flow between the multipole systems. For better collisional fragmentation (CID), heavier gases like nitrogen or argon can be used for the second gas flow to make the collisions more energetic. For electron transfer dissociation (ETD), suitable negative ions can be transferred from a second ion source into the second gas flow. Mass filter and fragmentation cell can be enclosed by a narrow enclosure to keep the gas flow free of losses.

In this way, the usual fall and rise and fall again of the vacuum pressure in tandem mass spectrometers over many orders of magnitude is completely avoided. The vacuum pressure now drops continuously from the pressure of the ion source, quite often at atmospheric pressure, to the mass filter and fragmentation cell, and further to the pressure of the analyzer. The gas flow to guide the ions through the mass filter and fragmentation cell can be easily generated by a nozzle of right dimension in the wall between the vacuum stages. By operating a mass filter with a gas flow under medium vacuum conditions, it is possible to omit several differential pumping stages and several acceleration voltage generators, which is particularly advantageous in the case of triple quadrupole mass spectrometers, but also for time-of-flight mass spectrometers or ion cyclotron resonance mass spectrometers equipped with parent ion selectors and cells for a fragmentation of the selected parent ions.

An RF quadrupole rod system used as a mass filter, with DC voltages applied to it in addition to the RF voltage, operates correctly, against expectation of most scientists skilled in the art, in the medium vacuum range if a gas flow of moderate speed moves the ions along its axis. In mass spectrometers according to the prior art, the mass filter is embedded in a vacuum chamber with a pressure preferably below $10^{-3}$ pascal so that the ions, after a short acceleration, can fly freely and practically without collisions through the mass filter. If, however, the ions in the quadrupole mass filter are moved at similar or even lower speeds by the gas flow instead of flying freely, the quadrupole mass filter can, when operated in the medium vacuum region, successfully transmit ions within specific mass ranges, while filtering out the other ions, by means of the interplay of the focusing RF and the defocusing DC voltages.

This use of a gas flow can be complemented by provision of other targeted gas jets in the medium-vacuum region, including supersonic gas jets, e.g., for use in combination with RF multipole systems for the transport of ions. The ions can be held radially in the gas jet by collisional focusing inside the RF multipole systems. Supersonic gas jets can, for instance, be generated by Laval nozzles, and be used for the loss-free introduction of ions into RF multipole systems, which usually is a difficult process. Using supersonic gas jets, ions can be introduced into chambers with higher pressure via compression funnels without the aid of electric fields. Using curved or angled RF multipole rod systems, ions can be extracted from the gas jet again; the gas jet from which the ions have been removed can deliver its gas into a special pump chamber, without significantly burdening the rest of the vacuum system with its gas load.

Celsius), the maximum velocity of the molecules in the supersonic gas jet is $w_{max}$=792 meters per second.

Figure 11:
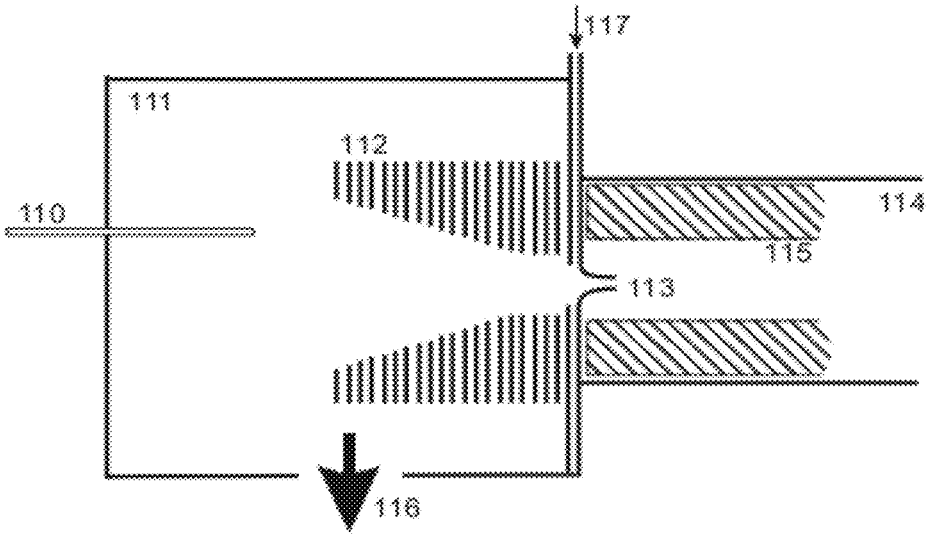

FIG. 11 exhibits a greatly simplified ion inlet system for ions from an atmospheric pressure (API) ion source to a mass filter (115). The ions from the API source are carried as usually by gas through the inlet capillary (110) into the first stage (111) of a differential pumping system, directed off-axis into the ion funnel (112). Ions are guided by the funnel towards the nozzle (113) representing the first part of a Laval nozzle, but lacking the widening part. This nozzle (113) generates inside the mass filter (115), if correctly designed, a short gas jet which decays rapidly and transforms quickly to a laminar flow to keep the ions inside the mass filter for many periods of the RF voltage. The inlet (117) allows to replace the gas coming through inlet capillary (110) by another gas, e.g. helium or hydrogen, better suited for the operation of the mass filter (115). Pump (116) evacuates the pumping stage (111). The enclosure (114) tightly embraces the electrodes of the mass filter (115) to keep the gas flow inside the mass filter.

PREFERRED EMBODIMENTS

As pointed out above, the invention primarily provides a mass spectrometer with an RF quadrupole rod system, operated as mass filter or mass analyzer in the medium vacuum regime, utilizing a gas flow to drive the ions are through the analyzer. Furthermore, the invention provides a tandem mass spectrometer in which an RF quadrupole rod system is operated as a mass filter at vacuum pressures in the medium vacuum pressure regime, utilizing a gas flow of moderate speed to drive the ions through the mass filter, and in which an RF multipole rod system serves as fragmentation cell at the same pressure. The gas flow is generated by a nozzle in the wall between two vacuum stages of a differential pumping system. The ions enter the RF quadrupole mass analyzer or filter entrained by the gas beam generated by the pressure difference across the nozzle. To make the ions enter the nozzle, the ions may be collisionally focused by an RF multipole system located directly in front of the nozzle.

The gas flow is formed by the pressure difference and the inner diameter of the nozzle. Inside the RF quadrupole mass analyzer or mass filter, a laminar gas flow is formed, the speed of which depends on the amount of gas flowing and the inner cross section of the RF quadrupole rod system. Favorably, the RF quadrupole rod system is enclosed by a narrow enclosure guiding the gas flow. The laminar flow has a maximum speed in the center axis, and drops radially to the rods of the quadrupole rod system. The gas speed should be in the range of 1 to 100 meters per second, a favorable speed is 10 meters per second. If the nozzle cannot be made small enough, the speed of the laminar flow may become too high for a good selection, but then a part of the gas flow can be made leaving the enclosure by holes in the wall of the enclosure.

Thus the invention concerns quadrupole mass analyzers and filters, which are operated in a medium vacuum. According to the prior art, mass filters are only used in a high vacuum. In order for the ions to be effectively selected, they must undergo several hundred cycles of the RF voltage in the mass filter; the more, the better. They must therefore be injected relatively slowly, i.e. with low kinetic energy, normally of just a few electronvolts. Mass filters have, however, an unfavorable acceptance profile for the injected ions, in particular for those with low injection energy; for this reason, many ions are not admitted to the mass filter at all. Great efforts have been made in the past to solve this problem, for instance through the use of Brubaker pre-filters or capillaries made of "leaky dielectric", in an attempt to improve the injection yield. If, however, ions are injected by means of a narrow gas beam out of a fine nozzle, insertion into the mass filter is much easier, overcoming repelling stray field pseudopotentials in the inlet area of the quadrupole rod system.

Although it is well-known that two-dimensional and three-dimensional RF ion traps only correctly work with a gas load in the medium vacuum regime, it is a surprise to many specialists in the field that a mass filter also operates in a medium vacuum regime. The interaction of focusing and defocusing, of radial stabilization by the RF voltage and destabilization by the DC voltage does also work in the medium vacuum range. On the one hand this is due to the high ion mobility in a gas of this pressure, and on the other hand due to the fact that the mean free paths of the ions are still relatively long. At a pressure between 0.5 and 5 pascal, the mean free path is still between 20 and 2 millimeter, even though the particle density, between $10^{14}$ and $10^{15}$ molecules per milliliter, is quite high. In order to be correctly filtered, the ions must be subjected to enough periods of the RF voltage. At a velocity of the gas flow of around 10 meters per second, and a short quadrupole mass filter with a length of only about 10 centimeters operated with an RF voltage of about one megahertz, the ions experience 10 000 RF periods, enough for most ion selection purposes.

This mode of operation seems to work even better than an operation in high vacuum. In high vacuum, a few ions of any mass have a chance to fly exactly along the field-free axis; these ions form a background noise which can be suppressed only by very long quadrupole systems. In the operation mode in medium vacuum, however, these ions have no chance to pass since they undergo multiple collisions and are often deflected into the range where the RF and DC potentials are effective. A high quality selection thus can be achieved with rather short quadrupole rod systems.

To improve the operation of the mass filter, a light gas may be used to drive the ions through, such as helium or even hydrogen. The gas may be introduced by an replacement arrangement around the nozzle (113), as shown in FIG. 11. Usually, pure nitrogen carries the ions through the inlet capillary (110) into the first vacuum chamber (111). This nitrogen can be replaced around the nozzle (113) to the mass filter (115) by helium or hydrogen through inlet (117). It does not really matter if this replacement is complete or not, a high part of helium or hydrogen already helps to improve the mass filtering. For light gases, the vacuum pressure inside the mass filter might be somewhat corrected to higher values.

For this operation of a mass filter in a medium vacuum regime, it is advantageous, if the electrodes of the mass filter and the support structure to hold the electrodes in place form a closed enclosure so that the gas flow does not find any way out. Such closed quadrupole rod systems are known since long in prior art.

In tandem mass spectrometers, the operation of a mass filter in a medium vacuum simplifies the chain of pumping stages, thus reducing the cost. No intermediate pumping stages for the transition to the high vacuum have to be installed before and after the mass filter. This is a very significant advantage, in particular for triple quadrupole mass spectrometers, but likewise for time-of-flight mass spectrometers (OTOF-MS) or ion cyclotron resonance mass spectrometers (ICR-MS) equipped with parent ion selectors and cells for collisional fragmentation of the parent ions. Furthermore, several generators for acceleration voltages can be saved, because the gas flow takes over the transport of ions.

In prior art tandem mass spectrometers, a collision cell for fragmentations operated at higher pressure usually follows the mass filter. In most cases, the collision cell is a quadrupole rod system with the same cross section as the selection mass filter. In mass spectrometers that are designed according to the prior art, the ions must be transported out of the mass filter into this collision cell against the direction of the reverse gas stream that is flowing out of the collision cell, and this requires special measures to be taken. The special measures usually enclose a complete intermediate vacuum stage with an additional ion guide, additional apertured diaphragms, electronics for the additional ion guide, and voltage generators to accelerate the ions against the gas flow. The invention allows to omit all these measures, since the RF multipole rod system used as collision cell can usually be operated at the same pressure as the RF quadrupole mass filter, without any apertured diaphragm in between.

There are several methods to fragment the selected parent ions. For instance, a voltage of some 30 to 200 volts between mass filter and collision cell may accelerate the ions into the collision cell where they fragment by a multitude of collisions with the gas molecules of the gas flow. In another embodiment, the ions may undergo radial resonant excitation by an AC excitation voltage applied to some rods of the multipole rod system, superimposed to the RF voltage. The excited ions experience many collisions with the gas molecules and finally decay if they had gathered enough internal energy.

If a light gas like helium or hydrogen is used in the mass filter, collisional fragmentation in the fragmentation cell may become impossible for larger ions within this light gas, because there is no or too low energy transfer into the ions by the collisions with the light gas molecules. To improve collisional fragmentation, a second flow of heavier gas molecules may be introduced into the flow of light gas between mass filter and fragmentation cell, e.g., nitrogen, carbon dioxide or even argon. The introduction may be performed by a merger system, as outlined in FIG. 6. The heavy gas may be introduced into the second gas flow by a replacement arrangement similar to that shown in FIG. 11, applied to nozzle (15) in FIG. 1.

Figure 6:
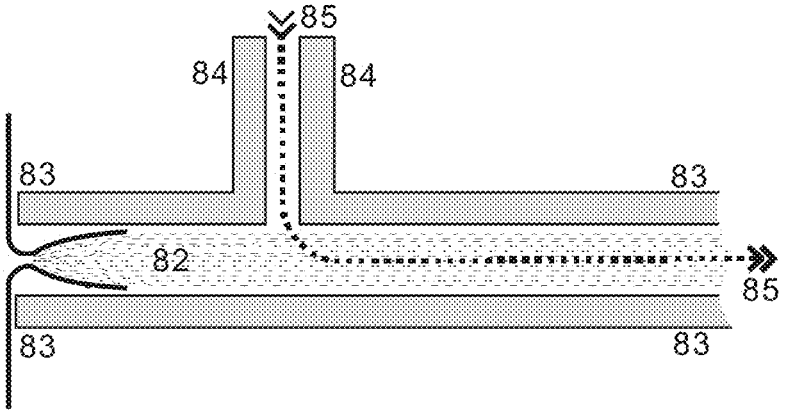
FIG. 6 illustrates a kind of lateral introduction of ions (85) through a quadrupole rod system (84) into a gas jet (82) within a hexapole rod system (83). The two joined multipole systems serve as a gas flow merger. RF multipole rod systems can be joined together in such a way that they can be operated with the same RF voltage (See, for instance, GB 2 415 087 B or U.S. Pat. No. 7,196,326 B2; J. Franzen and E. N. Nikolaev, 2004). In this way, ions can be introduced into an ion-free gas jet; but more interesting is the introduction of, for example, negative reaction ions into a gas jet transporting positive analyte ions for electron transfer dissociation (ETD) of the analyte ions. This kind of merging gas flows is only one of several possibilities, lateral introduction of a second gas flow and of ions can be performed in several different ways, known by the specialist in the field.

Another possibility to fragment selected positive parent ions of multiple charges is a dissociation by electron transfer from suitable negative ions. The negative reaction ions can be laterally introduced into the main gas flow through the fragmentation cell by a gas merger system (13) of FIG. 1. A joined multipole rod system with an extra gas flow may be used as gas merger system, as illustrated in FIG. 6. The negative reaction ions are laterally introduced by a second gas flow, merging with the main gas flow. Reaction ions can be generated in special electron attachment ion sources in large amounts, so that losses during the introduction do not play a decisive role. If the fragmentation quadrupole rod system is enclosed by a narrow enclosure, the two gas flows will combine to a single laminar gas flow, and the positive and negative ions will quickly mix by collisional focusing.

The use of a relatively slow laminar gas flow within the RF quadrupole mass filter does not mean that the generation and use of supersonic jets are not advantageous in many other devices and procedures within mass spectrometers.

Methods and devices according to the invention utilizing supersonic gas jets as well as laminar gas flows will be described here in the context of the tandem mass spectrometer illustrated in FIG. 1. The tandem mass spectrometer contains, as is often the case, a quadrupole mass filter (12), whose mode of function in the medium vacuum region has been outlined above, a fragmentation cell (14), and a time-of-flight mass spectrometer (23-27) with orthogonal ion injection (OTOF). In spite of its similarity to mass spectrometers of the prior art, this instrument is very unusual, due to the application of inventive methods and devices.

Figure 1:
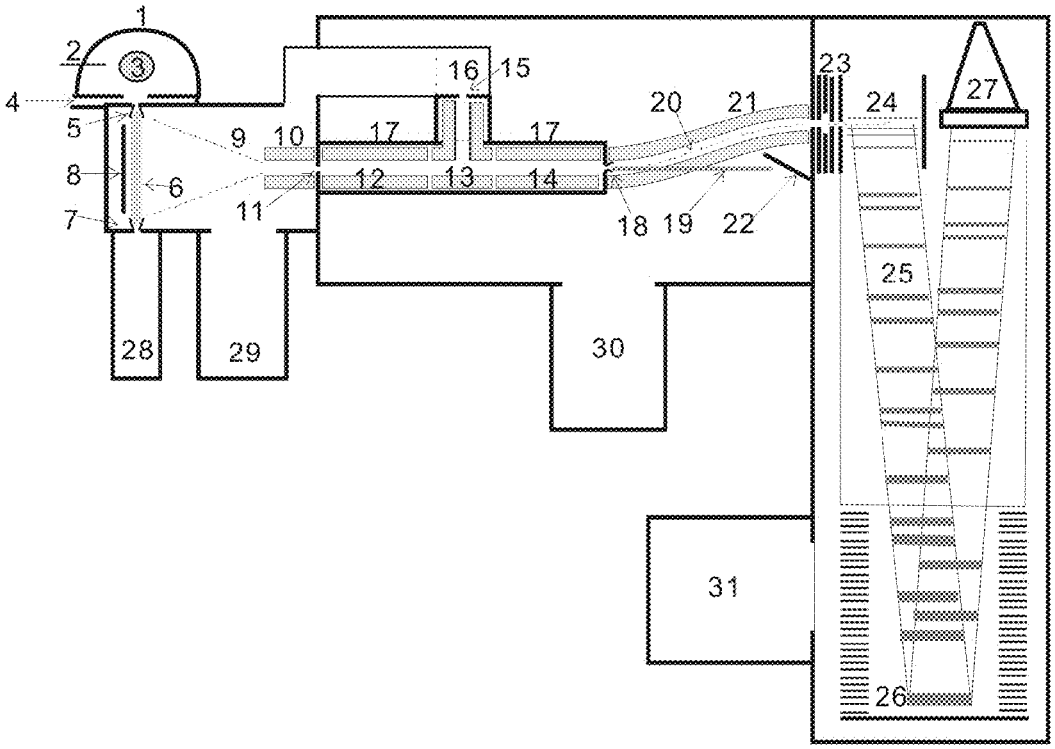
FIG. 1 represents a tandem mass spectrometer with mass filter (12), fragmentation chamber (14) and time-of-flight mass spectrometer (23-27), in which methods and devices according to this invention are used a number of times. The electrospray ion source (1) with spray capillary (2) creates, in the known way, a cloud (3) of ions in ambient gas. The ions, guided by electric fields (not shown), drift through the added inert gas (4) to the Laval nozzle (5), which generates a supersonic gas jet (6) with a pressure of around 200 pascal from the sucked in inert gas (4) and the ions. After crossing the vacuum chamber, this supersonic gas jet is compressed in the compression funnel (7), and is then sucked out by the forepump (28) without its gas load significantly burdening the vacuum system of the mass spectrometer. The ions are driven out of the supersonic gas jet (6) by an electrode (8), and are fed to the ion funnel (9). The ion funnel (9) leads to a quadrupole rod system (10), which accumulates the ions on its axis and leads them to the nozzle (11). The nozzle (11) generates, after a short transition phase, a laminar gas flow with a pressure of about two pascal which carries the ions through the quadrupole mass filter (12) for the selection of parent ions, and guides them through the gas flow merger (13) into the fragmentation cell (14), all enclosed by enclosure (17). A voltage applied between the gas flow merger (13) and the quadrupole rod system (14) of the fragmentation cell gives the ions the desired collision energy for collisionally induced fragmentation, if required (CID=collisionally induced decomposition). The fragment ions drift with the gas flow to the Laval nozzle (18) that generates a supersonic gas jet (19); this emerges from the curved guide quadrupole (21) and is deflected towards the vacuum pumps by deflection shield (22). The beam of ions (20) is fed by the curved quadrupole (21) to the lens unit (23), and this generates a very fine ion beam from which segments are pulsed out by the pulser (24), perpendicularly to the previous flight direction, as an ion beam (25), reflected in the reflector (26) and then detected by the ion detector (27), time-resolved. Instead of CID, selected parent ions may be fragmented by electron transfer dissociation (ETD), utilizing negative reaction ions produced in the electron attachment ion source (16) and fed through nozzle (15) into the gas flow merger (13) by a second gas flow.
Figure 2:
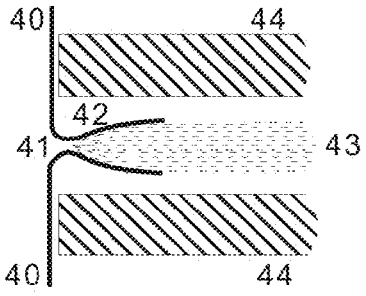
FIG. 2 schematically illustrates a Laval nozzle (42) with a rounded inlet (41) in a partitioning wall (40) between two regions of different pressure. If the shape of the widening of the nozzle's outlet is properly designed for the pressure ratio, a sharply defined, parallel supersonic gas stream (43) is generated, in which the accompanying ions are held together by an RF quadrupole rod system with pole rods (44), and are collision focused into the axis of the rod system. A Laval nozzle consisting of a high-resistance conducting dielectric material is particularly advantageous because the RF alternating field then extends through the material.

In the mass spectrometer according to FIG. 1, an electrospray ion source (1) with a spray capillary (2) creates a cloud (3) in the usual way of ions in ambient gas. The ambient gas is mainly laboratory air, but also contains solvent from the spray liquid. The ions are guided by electric fields, not shown, on the basis of their mobility, through the gas to the Laval nozzle (5). At the same time the ambient gas is replaced with added inert gas (4), usually pure nitrogen.

The Laval nozzle (5) generates a supersonic gas jet (6) from the inert gas (4) that has been sucked in and which now contains the ions that have drifted in. If, for instance, the Laval nozzle (5) has a narrowest diameter of 0.5 millimeters, and if the pressure in the first vacuum chamber is 200 pascal, it will suck in 2.4 liters of gas per minute, and if the Laval nozzle (5) is well shaped, a focused, parallel supersonic jet (6) with a diameter of 2.4 millimeters will be formed. If the narrowest diameter of the Laval nozzle (5) is 0.6 millimeters, 3.4 liters of gas per minute will generate a supersonic jet (6) with a diameter of 2.9 millimeters, provided the Laval nozzle (5) is properly shaped for this case. If the inert gas (4) (usually nitrogen) enters with a temperature of 300 kelvin, the velocity of the supersonic gas jet (6) will be around 700 meters per second; the temperature in the supersonic gas jet will be approximately 50 kelvin. The supersonic gas jet (6) crosses the vacuum chamber, and enters the compression funnel (7), where it is compressed, raising its pressure to the point where a forepump (28) can suck it out without its gas load significantly burdening the remaining vacuum system of the mass spectrometer. If all of the nozzles are properly dimensioned, well over 90 percent of the gas can be pumped out by the forepump. If the gas that is sucked in through the Laval nozzle (5) were still to contain a significant proportion of polar solvents or water, these components would freeze to form small and extremely hard ice crystals, supported by the ions acting as condensation nuclei. These crystals would then strike the compression funnel at the speed of a bullet, and would soon wear it out. Replacing the ambient gas with inert gas is therefore important, although the compression funnel should nevertheless be made from an extremely hard material such as titanium.

If the path between the Laval nozzle (5) and the compression funnel (7) is about 7 centimeters, then the molecules in the supersonic gas jet will travel this distance in about 100 microseconds. The ions must be extracted from the supersonic jet in this time. This is possible because the ions have a high mobility due to the low temperature in the supersonic gas jet, and they can therefore be extracted within this period by an electric field of about ten to thirty volts per centimeter. This electric field is generated by the electrode (8), in conjunction with the potential of the ion funnel (9). It is also possible to attach a second electrode on the other side of the supersonic gas jet (6) in the form of a very fine grid. The ion funnel, whose mode of operation is known to every specialist, guides the ions into the ion-focusing quadrupole rod system (10) and through it to the nozzle (11).

Starting from an pressure of about 200 pascal in the first vacuum chamber, the nozzle (11) generates a gas flow which passes through the RF quadrupole mass filter (12). If the nozzles (11), (15) and (18) are dimensioned correctly, then a laminar gas flow with a speed of about 10 meter per second and an internal pressure of about two pascal can be generated inside the quadrupole mass filter (12). Depending on the analytical task, the mass filter (12) transmits either all the ions or only the ions from a selected range of masses $\Delta(m/z)$ around a particular charge-related mass m/z. The ions are then post-focused in the gas flow by a focusing quadrupole rod system (13), which also serves as a gas and ion beam merger, and are guided to the fragmentation cell (14), being formed by a multipole rod system, wherein the ions can be fragmented. In a preferred embodiment, the mass filter (12), the beam merger (13), and the fragmentation cell (14) are enclosed by a narrow enclosure (17).

If daughter ion spectra are to be acquired, the parent ions are selected in the known way in the mass filter (12) and freed from all the other ions so that only the selected parent ions are transported into the fragmentation cell (14). If the ions do not have to be selected, the mass filter (12) can be used as a simple guiding quadrupole system by switching off the DC voltages, in which case all the ions will then be transported into the fragmentation cell. Operating a mass filter at a pressure of two pascal, i.e. with a particle density of $5\times10^{14}$ molecules per milliliter is very unusual; it is made possible by the high ion mobility and by the mean free path of the ions, which is around five millimeters. Operation may still be improved by use of light gases, as described above. If a quadrupole rod system with an internal diameter of six to eight millimeters, a length of about 100 millimeters and an operating RF frequency of around one megahertz is used as mass filter (12), the ions experience more than 10 000 periods of the radio frequency, easily enough for an acceptable selectivity.

If the ions are to be subjected to collisional fragmentation (CID) in the fragmentation cell (14), a voltage between the quadrupole merger system (13) and the multipole rod system (14) in the order of 30 to 200 volt gives the ions the desired collision energy. Fragmentation does not occur if this voltage is switched off. The ions, or fragment ions as the case may be, are held together by the multipole rod system (14), and are transported neatly focused to the Laval nozzle (18) by the gas flow. In an alternative embodiment for collisional fragmentation, the ions may be resonantly excited in radial direction inside the fragmentation cell (14) by an AC voltage applied, in addition to the RF voltage, to at least one pair of rods of the multipole rod system (14).

If the selected parent ions should be fragmented by electron transfer dissociation (ETD), the necessary negative reactant ions can be produced in an electron attachment ion source (16), operating at about 200 pascal. The negative reactant ions can be transported by a second gas flow through nozzle (15) into the gas merger system (13) and combines with the first gas flow from nozzle (11). The negative and positive ions quickly mix by collisional focusing and start the fragmentation by electron transfer.

The Laval nozzle (18) generates a supersonic gas jet (19) from the gas in the fragmentation cell (14), enclosed by the enclosure (17), which has a pressure of about two pascal. If the Laval nozzle has a narrowest diameter of 1.5 millimeters, and if the outlet pressure is 0.02 pascal, then a supersonic gas jet (19) with a diameter of 4.3 millimeters is created. This supersonic gas jet (19) transports the gas out of the fragmentation cell (14) into a curved ion guide (21) which guides the ions (20) away from the supersonic jet (19) into the lens system (23) of the time-of-flight mass spectrometer (24-27). In this way, the gas jet (19) is not impacting with its forward pressure on the lens unit (23).

The lens unit (23) forms a very fine ion beam, out of which individual segments are pushed by the pulser (24) in the known manner, perpendicularly to the prior direction of flight, to form an ion beam (25), the ions of which are velocity focused by the reflector (26), and detected highly time-resolved by the ion detector (27). The mode of operation of a time-of-flight mass spectrometer of this sort with orthogonal ion injection is known to every specialist in the field. The only unusual aspect here is that the apertures of the lens unit (23), which also serve to provide pressure separation from the vacuum system of the time-of-flight mass spectrometer, are not subject to the forward pressure of the gas flowing out of the collision chamber, which means that, in principle, a smaller pump (31) can be selected for the time-of-flight mass spectrometer.

The advantage of a mass spectrometer of this type is that a differential pumping system with a significantly lower capacity can be used. Apart from the roughing pumps (28) and (29), only two turbomolecular pumps (30) and (31) are required. These pumps must be able to maintain a pressure of 200 pascal in stage (29), a pressure of 0.02 pascal in stage (30), and a pressure of $10^{-5}$ pascal in stage (31). The electronics required to supply the quadrupole rod system and to provide the potential differences needed for transporting the ions through the individual stations can also be simplified significantly. The savings thus not only concern the pump capacities, but also the electronic supply. The mass filter (12) requires, as usual, an RF generator that can also supply superimposed DC voltages.

It was already mentioned above that supersonic gas jets may be advantageous for certain applications. Any supersonic gas jet can be manipulated by specialized devices in a number of different ways. It is advantageous here that any disturbance of the supersonic gas jet can never act backwards into the gas jet, since no disturbances can propagate faster in gases than the speed of sound. There are also a few laws that apply to subsonic gas flows but not to supersonic gas jets. Thus, for a subsonic flow of gas in an enclosure, widening is always associated with deceleration and an increase in pressure, while a constriction is associated with acceleration and a reduction in pressure, as is known from, for instance, water jet pumps or Venturi nozzles; the opposite, however, applies to a supersonic gas jet: widening is associated with acceleration and a reduction in pressure, while a constriction, on the other hand, brings deceleration and an increase in pressure.

Figure 3:
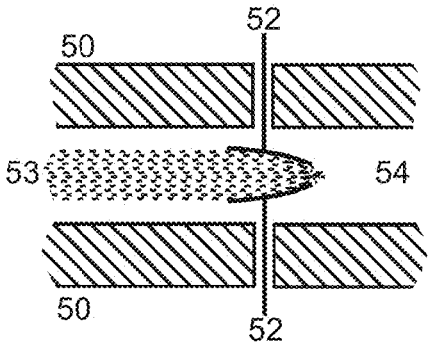
FIG. 3 illustrates how a supersonic gas jet (53) is compressed by a compression nozzle in a partition (52) between two regions of different pressure so that the gas of the supersonic gas jet (53) is transported into the region (54) where the pressure is higher. The ions in the supersonic gas jet that are collision focused into the axis by the quadrupole rod system (50) are also transported into the region (54) where the pressure is higher. As long as at least local speed of sound prevails in the narrowest cross-section of the compression nozzle, the compression nozzle can accept and transmit the gas of the supersonic gas jet, and no blockage develops along the axis.

This can, for instance, be exploited in order to push ions into a region of higher pressure without the aid of electric fields. FIG. 3 shows schematically how a supersonic gas jet (53), somewhere generated in a mass spectrometer, is compressed by a compression nozzle in a partition (52) between two regions of different pressure so that the gas of the supersonic gas jet (53) is transported into the region (54) where the pressure is higher. The ions in the supersonic gas jet that are collision focused into the axis by the quadrupole rod system (50) are also transported into the region (54) where the pressure is higher. The design of the compression funnel is critical; the funnel has to be very slender not to reflect the gas jet sharply. As long as at least local speed of sound prevails in the narrowest cross-section of the compression nozzle, the compression nozzle can accept and transmit the gas of the supersonic gas jet; no blockage develops therefore, at least along the axis. The compression factor depends strongly on the shape of the compression nozzle. It is relatively easy to generate compression factors in the range between about two and five; higher compression factors are more difficult, and call for computer simulations and experimentation. The terms "compression nozzle" and "compression funnel" are intended here to refer to very different forms, including those that do not have the shape of a funnel at all but, for instance, the shape of a simple hole in a wall to a chamber of slightly higher pressure, which hole is also capable to generate compression.

This phenomenon can be used to create a collision chamber of higher pressure that does not require an additional gas supply. Inside this collision chamber, the ions are held together radially by an RF multipole rod system, and are guided axially by the movement of the gas. The ions can be given their collision energy by a potential difference of some 30 to 200 volts between the compression nozzle and the rod system.

Figure 4:
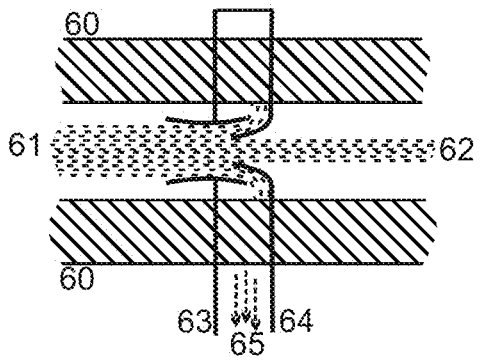
FIG. 4 illustrates how a supersonic gas jet (61) is trimmed in a quadrupole rod system (60) by a gas skimmer (64), and the skimmed gas is fed through a compression nozzle (63) into a pump chamber (65), from where it can be pumped away. Since both the compression nozzle (63) and the gas skimmer (64) consist of high-resistance conducting dielectric material, the rods of the quadrupole system (60) can be introduced through their supporting wall without significantly interfering with the RF field. The trimmed supersonic gas jet (62) must continue to move through an environment that is at the same pressure.

For some applications of the supersonic gas jet in which wide boundary regions are problematic, these can be trimmed off by skimmers, as is shown schematically in FIG. 4. Here, a supersonic gas jet (61) in a quadrupole rod system (60) is trimmed by a gas skimmer (64), and the skimmed gas is fed through a compression nozzle (63) into a pump chamber (65), from where it can be pumped away. If both the compression nozzle (63) and the gas skimmer (64) consist of high-resistance conducting dielectric material, the rods of the quadrupole system (60) can be introduced through their supporting wall without significantly interfering with the RF field. The trimmed supersonic gas jet (62) must continue to move through an environment that is at the same pressure. Skimmers are particularly useful in association with compression nozzles, since they can increase the compression factor, even though the full quantity of gas is not compressed.

Figure 5:
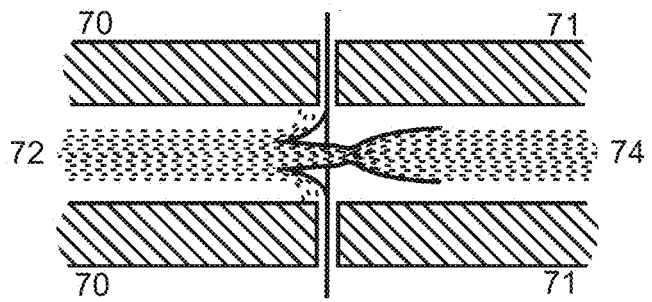
FIG. 5 shows how a supersonic gas jet (72) can be trimmed in a quadrupole system (70), after which the trimmed partial gas stream can be shaped in a Laval nozzle into a new supersonic gas jet (74) that is now adapted to lower ambient pressure and moves through the quadrupole system (71).

It is also possible for supersonic gas jets to be regenerated between regions of different pressure. FIG. 5 illustrates schematically how a supersonic gas jet (72) can be trimmed in a quadrupole system (70), after which the trimmed partial gas stream can be shaped in a Laval nozzle into a new supersonic gas jet (74) that is now adapted to the lower ambient pressure and that flies through the quadrupole system (71).

The ions are most often introduced into the supersonic gas jet by being already present in the gas from which the supersonic gas jet is created. This, however, must not be the case. FIG. 6 illustrates the lateral introduction of ions (85) through a quadrupole rod system (84) into a gas jet (82) in a hexapole rod system (83). Quadrupole and hexapole rod systems (and in fact other RF multipole rod systems, such as two quadrupole rod systems) can be joined together in such a way that they can be operated with the same RF voltage. The ions are generated in an extra ion source and transferred into the second gas flow fed into the merging quadrupole system. The second gas flow then merges with the first gas flow.

The lateral introduction of ions may also be used to mix different kinds of ions, a first kind being already flying in the first gas flow, and a second kind of ions added from a second ion source. This introduction is most interesting for the initiation of reactions between different kinds of ions with different polarities. Because both types of ions are immediately collision focused in the main gas flow, reactions start immediately. Such reactions can be used, for example, for the fragmentation of ions by electron transfer dissociation (ETD), as already described above. The lateral introduction may take place between a mass filter and a fragmentation cell usually used for collisional fragmentation; such cells offer the choice between collisional fragmentation and fragmentation by electron transfer.

Figure 7:
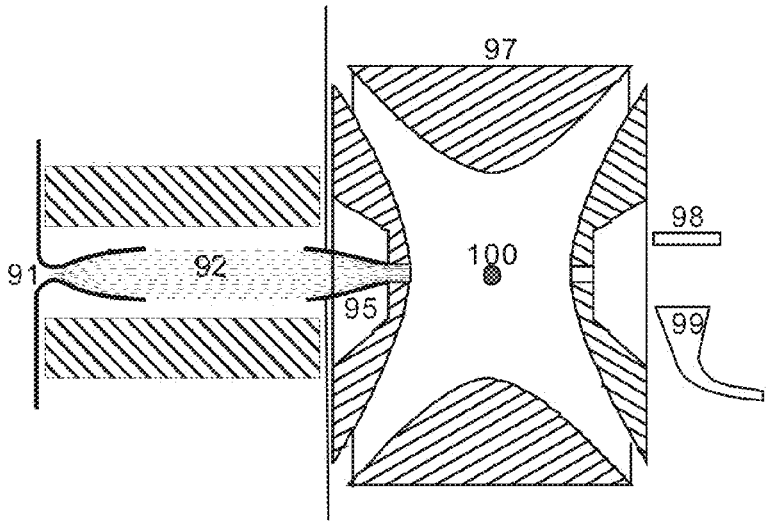
FIG. 7 illustrates how a supersonic gas jet (92) pushes ions through a compression funnel (95) into a three-dimensional RF ion trap (97) while at the same time establishing the working pressure in the ion trap (97). It is expedient here to create the supersonic gas jet (92), by means of the Laval nozzle (91), from helium, since the ion trap (97) operates most effectively with helium as the damping gas for the ion oscillations. The ions whose movements have been damped then accumulate in a small cloud (100) in the center of the ion trap (97). Known methods can then be used for mass-sequential ejection of the ions and for their measurement as a mass spectrum using a conversion dynode (98) and a channeltron (99).

The methods of manipulating gas jets can be implemented in various ways. FIG. 7 illustrates schematically how a supersonic gas jet (92), generated by the Laval nozzle (91), pushes ions through a compression funnel (95) into a three-dimensional RF ion trap (97) while at the same time establishing the working pressure in the ion trap (97). It is expedient here to create the supersonic gas jet (92) from helium, since the ion trap (97) operates most effectively with helium as damping gas for the ion oscillations. The ions whose movements have been damped then accumulate in a small cloud (100) in the center of the ion trap (97). Known methods can then be used for mass-sequential ejection of the ions and for their measurement as a mass spectrum using a conversion dynode (98) and a channeltron multiplier (99). The ions can be introduced laterally into the supersonic jet of helium, for instance, as illustrated in FIG. 6.

Figure 8:
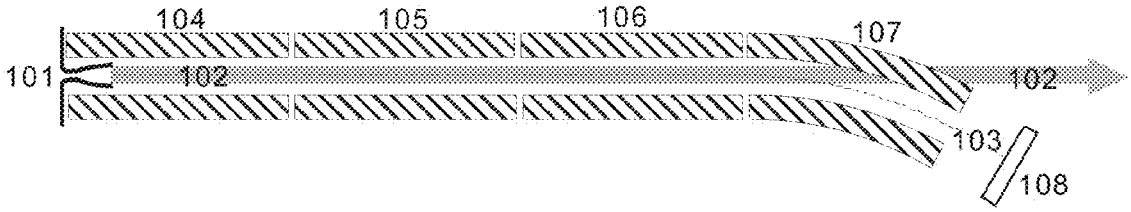
FIG. 8 exhibits the design of a triple quadrupole mass spectrometer ("triple quad") that is greatly simplified in comparison with the prior art, and that operates here in a medium vacuum at a pressure of about one pascal. The nozzle (101) creates the supersonic gas jet (102), and this passes through the three quadrupole systems (104), (105) and (106), but leaves the curved quadrupole system (107) in a straight line, while the ion beam (103) follows the curved quadrupole system and strikes the detector (108). The selection quadrupole (104) isolates the selected parent ion species, whose ions are accelerated by a voltage between 30 and 200 volts between the selection quadrupole (104) and the fragmentation quadrupole (105) and are injected into the fragmentation quadrupole, where they are fragmented through collisions with the gas molecules of the gas jet (102). The fragment ions are transported by the gas jet into the analyzer quadrupole, where they are analyzed in accordance with their charge-related mass m/z and measured in the detector (108). The method of operation and the fields of application of these triple quadrupole mass spectrometers, which account for the largest proportion of all mass spectrometers sold, are known to the specialist.

Several types of mass spectrometer can be improved by the devices according to the invention, including the mass spectrometer with the highest number of sales: the triple quadrupole mass spectrometer ("triple-quad"). FIG. 8 shows the design of a mass spectrometer of this type that is greatly simplified in comparison with the prior art. In contrast to the prior art, all three quadrupole systems are operated at the same pressure of about two pascal in a medium vacuum regime. A nozzle (101) creates a gas jet (102), and this passes through all three quadrupole systems (104), (105) and (106), and leaves the curved quadrupole system (107) in a straight line, while the ion beam (103) follows the curved quadrupole system and strikes the detector (108). The mode of operation and fields of application are known to the specialist: As in prior art, the quadrupole mass filter (104) isolates the selected parent ions species, but this is done here in the medium vacuum regime. The selected ions are accelerated by a voltage between 30 and 200 volts between the quadrupole mass filter (104) and the fragmentation quadrupole (105), and are injected into the fragmentation quadrupole, which operates at the same pressure. They are fragmented here by a large number of hard collisions with the gas molecules of the gas jet (102). The fragment ions are transported by the gas jet into the analyzer quadrupole, where they are selected in accordance with their charge-related mass m/z and measured in the detector (108). The triple quadrupole mass spectrometer is most often operated with a fixed parent ion mass and also with a fixed, characteristic daughter ion mass, as an extremely sensitive, substance-specific detection instrument in combination with gas or liquid chromatographs; it is also possible for the fixed settings to be changed at certain intervals (MRM=multi-reaction monitoring). Very large numbers of these mass spectrometers are used for series of tests on the effect of pharmaceutical products and their metabolism, as is specified for the approval of these active substances.

The triple quadrupole mass spectrometer may be improved by the lateral introduction of reactive ions for electron transfer dissociation into the fragmentation quadrupole, as illustrated in FIG. 6.

The triple quadrupole mass spectrometer is only an example for a full class of tandem mass spectrometers. The combination of quadrupole mass filters and quadrupole rod systems for ion fragmentation is used in a variety of different tandem mass spectrometers, as, for instance, time-of-flight mass spectrometers with orthogonal ion injection (Q-OTOF-MS, as illustrated in FIG. 1), or Fourier-Transform ion cyclotron resonance mass spectrometers (Q-FT-ICR-MS) which both offer much higher mass resolution than the triple-quad mass spectrometer. All these tandem mass spectrometers can be greatly simplified with respect to vacuum systems and electronics by application of this invention. In all these tandem mass spectrometers, the repeated rise and fall of pressure can be replaced by a continuously decreasing pressure towards the mass analyzer.

The familiar equations of gas dynamics can be used to calculate the conditions needed to generate a supersonic gas jet at a given initial pressure $p_0$, final pressure and temperature in front of the nozzle. For a Laval nozzle, the narrowest internal diameter 2r* is given by the desired gas flow; the optimum diameter at the outlet of the Laval nozzle can also be determined with these equations. The temperature in the supersonic gas jet and its velocity can also be calculated. For the optimum shape of a Laval nozzle, the "characteristics method", which determines the shape graphically, is usually used. The shape of an advantageous Laval nozzle can also, however, be determined by specifying a wanted smooth pressure curve p(x) in the axis of the Laval nozzle, making use of the "flow function" Ω:

$$\Omega(x) = \sqrt{\frac{\kappa}{\kappa-1}\left[1-\left(\frac{p(x)}{p_0}\right)^{\frac{\kappa-1}{\kappa}}\right]}\left(\frac{p(x)}{p_0}\right)^{\frac{1}{\kappa}}.$$

In the narrowest cross-section, $$\Omega_{max} = \left(\frac{2}{\kappa+1}\right)^{\frac{1}{\kappa-1}}\sqrt{\frac{1}{\kappa+1}}$$

applies.

Here, $p_0$ is the pressure upstream of the nozzle, κ is the isentropic exponent of the gas used, and x is the axial coordinate. The profile for the radius r(x) of the Laval nozzle is given by $r^2(x)=r^{*2}\Omega_{max}/\Omega(x)$, where r* is the narrowest radius of all cross-sections given by the desired gas flow.

Figure 9:
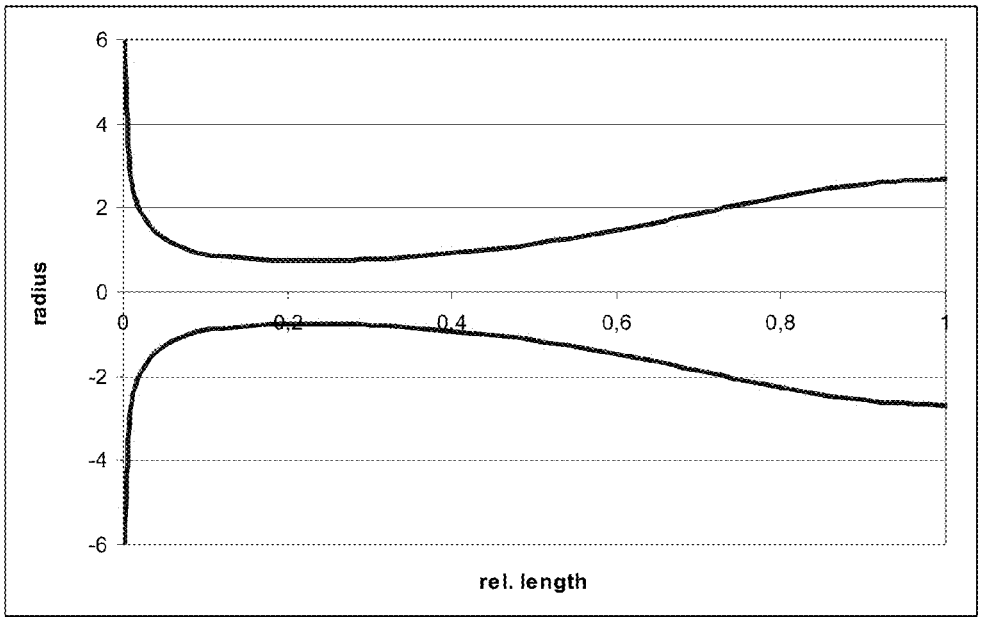
FIG. 9 reproduces the calculated shape for a Laval nozzle, the calculation being based on a specified, smooth (continuous and continuously differentiable) pressure curve between the two pressure chambers.

FIG. 9 illustrates the shape of a Laval nozzle that has been calculated using this equation; a smooth (continuous and continuously differentiable) pressure curve p(x) between the two pressure chambers was specified. The Laval nozzle has deliberately been elongated here in such a way that it creates a narrow cup in the region of the outlet. This is necessary because otherwise the supersonic gas jet would peel away from the wall before emerging from the nozzle.

Figure 10:
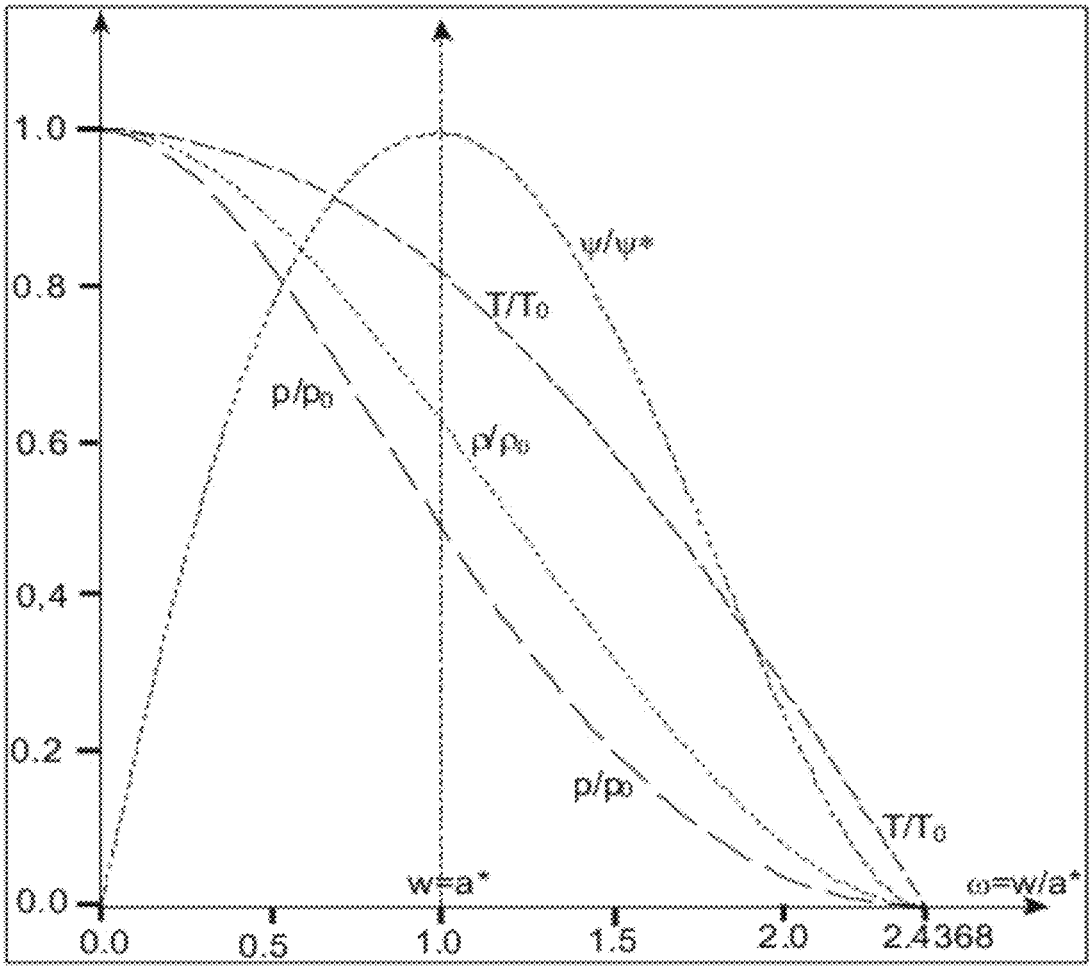
FIG. 10 presents the "outflow diagram" for compressible gases (in this case for nitrogen) from a region with pressure $p_0$, density $\rho_0$ and temperature $T_0$. The local pressure $p/p_0$, the local density $\rho/\rho_0$ and the local temperature $T/T_0$ are plotted against the relative gas velocity $\omega$, where the local gas velocity w is given with reference to the local speed of sound a* in the narrowest cross-section of the nozzle ($\omega=w/a^*$). The curve of the flow density $\psi=\rho\times w$ is given here with reference to the flow density $\psi^*$ in the narrowest cross-section. For the outflow of nitrogen into the vacuum, a maximum velocity for the supersonic gas jet is found to be $w_{max}=2.4368\times a^*$. For air flowing out under standard conditions (1000 hectopascal, 20°

For completeness, FIG. 10 illustrates what is known as the "outflow diagram" for compressible gases (in this case for nitrogen) from a region with pressure $p_0$, density $\rho_0$ and temperature $T_0$. The local pressure $p/p_0$, the local density $\rho/\rho_0$ and the local temperature $T/T_0$ are plotted against the relative gas velocity ω, where the local gas velocity w is given with reference to the local speed of sound a* in the narrowest cross-section of the nozzle (ω=w/a*). The curve of the flow density ψ=ρ×w is given here with reference to the flow density ψ* in the narrowest cross-section. For the outflow of nitrogen into the vacuum, a maximum velocity for the supersonic gas jet is found to be $w_{max}=2.4368\times a^*$. For air flowing out under standard conditions (1000 hectopascal, 20° Celsius), the maximum velocity of the molecules in the supersonic gas jet is 792 meters per second. Regardless of the shape of a nozzle, a supersonic gas jet always forms when the speed of sound is reached in the narrowest part of the nozzle. A Laval nozzle can, however, give the supersonic jet a particularly advantageous form, in which all molecules over most of the cross-section are moving with the same velocity and in the same direction.

With knowledge of the invention, those skilled in the art can develop further devices according to the invention and further applications of the devices.

The invention claimed is:

1. A mass spectrometer, comprising:

a Laval nozzle for the generation of a supersonic gas jet for guiding ions in a medium vacuum regime with a pressure between $10^2$ to $10^{-1}$ Pascal, wherein the Laval nozzle receives inert gas and the ions for generating the supersonic gas jet, and a compression funnel for accepting and transmitting the gas of the supersonic gas jet such that the ions are transported into a chamber at a pressure higher than the pressure in the medium vacuum regime.

2. The mass spectrometer of claim 1, further comprising a compression funnel and a three-dimensional ion trap wherein the supersonic gas jet pushes ions through the compression funnel into the three-dimensional RF ion trap while at the same time establishing a working pressure in the three-dimensional ion trap.

3. The mass spectrometer of claim 2, wherein the supersonic gas jet is a helium gas jet.

4. The mass spectrometer of claim 3, wherein the ions are introduced laterally into the supersonic jet of helium.

5. The mass spectrometer of claim 1, wherein the compression funnel has a shape that does not reflect the supersonic gas jet sharply.

6. The mass spectrometer of claim 1, wherein the Laval nozzle has a compression factor between two and five.

7. The mass spectrometer of claim 1, wherein one of the Laval nozzle and the compression funnel consist of high-resistance conducting dielectric material so that RF alternating fields may extend therethrough.

8. The mass spectrometer of claim 1, wherein the Laval nozzle has an outlet with a widening diameter and a shape of the widening produces a pressure ratio such that a sharply defined, parallel supersonic gas jet is generated by the Laval nozzle.

9. A mass spectrometer having a vacuum chamber and a vacuum system for reducing gas pressure in the vacuum chamber and comprising:

a Laval nozzle for the generation of a supersonic gas jet that includes an inert gas and ions and that guides ions into the vacuum chamber, wherein the Laval nozzle receives the inert gas and the ions for generating the supersonic gas jet;

an electrode that drives the ions out of the supersonic gas jet in the vacuum chamber; and a compression funnel for accepting and transmitting the gas of the supersonic gas jet into a second chamber having a pressure higher than the pressure in the vacuum chamber.

10. The mass spectrometer of claim 9, wherein the inert gas is pure nitrogen.

11. The mass spectrometer of claim 9, wherein the second chamber comprises a forepump that removes gas in the chamber so that most of the gas in the supersonic gas jet is removed by the forepump instead of the vacuum system of the mass spectrometer.

12. The mass spectrometer of claim 9, wherein the compression funnel is fabricated of titanium.

13. The mass spectrometer of claim 9, further comprising a potential source that produces an electric field between the electrode and one of an ion funnel and a second electrode located on a side of the supersonic gas jet opposite the electrode in order to drive the ions out of the supersonic gas jet.

14. The mass spectrometer of claim 9, wherein one of the Laval nozzle and the compression funnel consist of high-resistance conducting dielectric material so that RF alternating fields may extend therethrough.

15. The mass spectrometer of claim 9, wherein the Laval nozzle has an outlet with a widening diameter and a shape of the widening produces a pressure ratio such that a sharply defined, parallel supersonic gas jet is generated by the Laval nozzle.

* * * * *